US011503916B2

(12) United States Patent
Clarke

(10) Patent No.: US 11,503,916 B2
(45) Date of Patent: Nov. 22, 2022

(54) ADJUSTABLE BENCH-MOUNTABLE CUP HOLDER

(71) Applicant: Christopher Clarke, Park Ridge, IL (US)

(72) Inventor: Christopher Clarke, Park Ridge, IL (US)

( * ) Notice: Subject to any disclaimer, the term of this patent is extended or adjusted under 35 U.S.C. 154(b) by 0 days.

(21) Appl. No.: 17/359,420

(22) Filed: Jun. 25, 2021

(65) Prior Publication Data

US 2021/0401182 A1 Dec. 30, 2021

Related U.S. Application Data

(60) Provisional application No. 63/044,177, filed on Jun. 25, 2020.

(51) Int. Cl.
*A47C 7/62* (2006.01)

(52) U.S. Cl.
CPC ..... *A47C 7/622* (2018.08)

(58) Field of Classification Search
CPC ..... A47C 7/624; A47C 11/00; A47C 7/622; Y10S 224/926
See application file for complete search history.

(56) References Cited

U.S. PATENT DOCUMENTS

| | | | | |
|---|---|---|---|---|
| 4,697,780 | A * | 10/1987 | Wenkman | F16M 11/041 248/314 |
| 6,283,042 | B1 * | 9/2001 | Wargo | A47D 15/00 108/26 |
| 6,478,371 | B1 * | 11/2002 | Clarke | A47G 23/0225 297/188.2 |
| 7,131,688 | B2 * | 11/2006 | Steenson | A47C 7/70 108/157.11 |
| 8,636,319 | B1 * | 1/2014 | Parker, Jr. | A47C 7/62 297/188.21 |
| 10,722,037 | B2 * | 7/2020 | Pendleton, Jr. | A47C 7/624 |
| 11,064,810 | B2 * | 7/2021 | Snir | A47C 7/624 |
| 11,382,444 | B2 * | 7/2022 | Bruce | A47G 19/08 |
| 2017/0332794 | A1 * | 11/2017 | Melaragno | F16B 2/10 |
| 2019/0261797 | A1 * | 8/2019 | Tannehill | A47C 7/624 |
| 2019/0307253 | A1 * | 10/2019 | Pendleton, Jr. | A47C 7/624 |
| 2021/0045535 | A1 * | 2/2021 | Wilcox | A47C 4/52 |

* cited by examiner

*Primary Examiner* — Shin H Kim

(57) ABSTRACT

An adjustable bench-mountable cupholder has a bench connection bracket, an arm positioning bracket, an arm adjustment mechanism, a linkage arm, and a cupholder. The bench connection bracket is a rigid member that clamps the bench against a mounting surface of the arm positioning bracket. The arm positioning bracket enables the linkage arm to be articulatably connected to the bench. Specifically, the arm adjustment mechanism is a coupling system that is connected in between one end of the linkage arm and the arm positioning bracket; thereby enabling the linkage arm to be transitioned between a stowed configuration and a deployed configuration. The cupholder is detachably mounted onto the linkage arm and is positioned away from the arm positioning bracket. This enables the cupholder to be positioned at a desired location when deployed.

19 Claims, 8 Drawing Sheets

ADJUSTABLE BENCH-MOUNTABLE CUP HOLDER

The current application claims a priority to the U.S. Provisional Patent application Ser. No. 63/044,177 filed on Jun. 25, 2020.

FIELD OF THE INVENTION

The present invention relates generally to convenience devices. More specifically, the present invention relates to a cupholder designed to be mounted beneath a bench and folded into a stowed configuration away while not in use.

BACKGROUND OF THE INVENTION

Sports are introduced to humans at a very young age. Most children naturally enjoy sports because of the high level of energy and physical activity involved. As children grow up, some take sports more seriously and begin to play competitively while others remain playing sports for leisure. The latter usually tends to gravitate towards watching sports and eventually become fans who attend live sporting events. A live sporting event usually tends to attract large crowds, specifically if it is a professional sporting event.

The venues for such events are typically denoted as stadiums. Depending on the city, some teams share stadiums, meanwhile other teams have their own stadium. Attendance usually involves not only hiring parking attendance services, but also food services and other amenities. Stadiums tend to have various seating arrangements and different commodities available.

A common seating arrangement to see in any kind of stadium, whether it be big or small, is benches or bleachers. When the seating arrangement involves benches and bleachers, it is often hard for the audience to comfortably watch the sporting event while eating and drinking. Mainly because due to the arrangement of benches and bleachers it is hard to include functioning cup holders. The current cup holders that are attached to the benches or bleachers tend to be in the way and reduce aisle-space.

Therefore, it is the objective of the present invention to provide a convenient and simple apparatus which can be mounted to the underside of a bleacher/bench and retracts with ease for maximum space.

SUMMARY OF THE INVENTION

The present invention is an apparatus for holding cups, beverages or similar cylindrical objects. More specifically, an apparatus which mounts underneath a bench or a bleacher. The apparatus is designed specifically for benches and bleachers found in stadiums but is not limited to such. The present invention is designed for easy attaching and temporarily securing onto railings from stadium benches/bleachers. The present invention retracts with ease for maximum space handling and cleaning efficiency.

The present invention comprises a mount under bench/bleacher cup holder. Additionally, the mount under bench/bleacher cup holder comprises a bench rail mount, an intermediary bracket, a rotating arm and a cup receptacle.

The bench rail mount further comprises rail receiving receptacles which function as a hooking component between the underside railing from a bench/bleacher and the bench rail mount. The bench rail mount further comprises a slot orifice on the upper surface, or the surface closest to the underside railing from the bench/bleacher.

The intermediary bracket comprises a first pair of dimples and a second pair of dimples. Both the first pair of dimples and the second pair of dimples are located on the inner shelling of the intermediary bracket. The two locations for the first pair of dimples and the second pair of dimples are at a deploy location and a retract location. The deployed location and the retracted location are designed and placed such that when the rotary arm retracts or deploys, the rotary arm temporarily locks in place.

While deployed, the present invention is at mid-calf from the reference point of a user sitting down at a bleacher or bench. The present invention maintains a safe aisle clearance by positioning about 80 percent of the present invention underneath the bleacher plank. When the present invention is in a retracted position, the present invention is completely out of the way underneath the bleacher or bench in case of cleaning or maintenance.

It is also important to mention, if the bench or bleacher does not comprise a railing system, then there is no need for the mounting plate, and the remaining components are easily used in order to attach existing benches or bleacher without a railing system.

It is therefore the objective of the following document to explain and describe the invention to its fullest extent. Additionally, this document and the accompanying visual depictions are only intended to further aid in explaining the present invention and do not limit in any way, shape or form the scope of the invention.

DETAIL DESCRIPTIONS OF THE INVENTION

All illustrations of the drawings are for the purpose of describing selected versions of the present invention and are not intended to limit the scope of the present invention.

Referring to FIG. 1 through FIG. 8, the present invention, the adjustable bench-mountable cup holder, is a piece of entertaining equipment that provides a hands-free solution for storing personal items, such as drinks and cellphones, while a user is being entertained. Preferably, the present invention is mounted onto benches and chairs to provide the user a convenient place for storage when the user in close proximity to a large number of people. Fans in a crowded stadium is one example of such a group. While the primary use case for the present invention will be described as mounted on the underside of a bench, the present invention is adapted to provide storage options when mounted to devices selected from the group comprising, tables, ledges, walls, doorframes, and countertops. The present invention is designed as a repositionable cupholder that can be deployed when needed and then stowed away without encroaching on the user's personal space.

Figure 1:
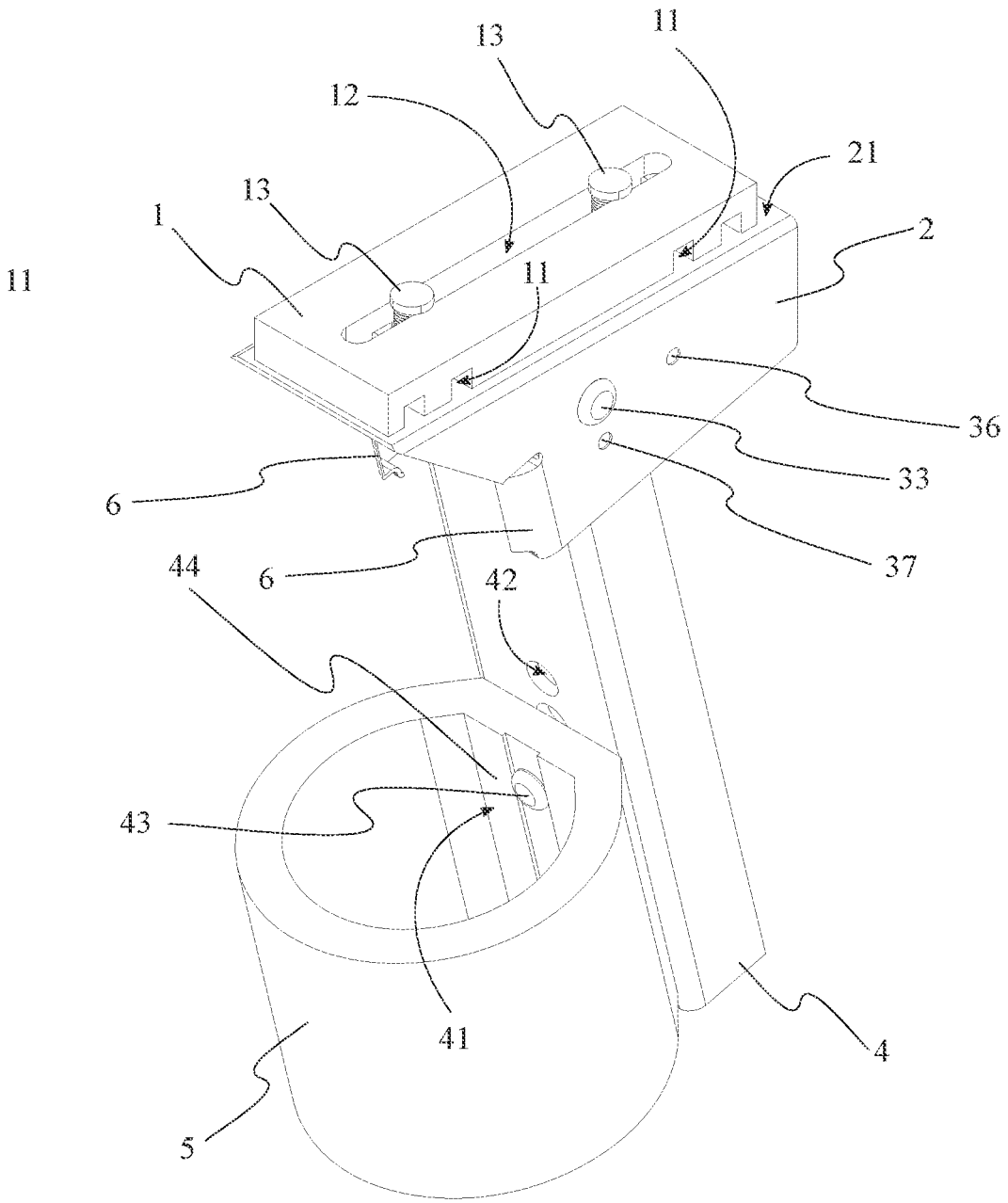
FIG. 1 is an isometric perspective view of the present invention.
Figure 2:
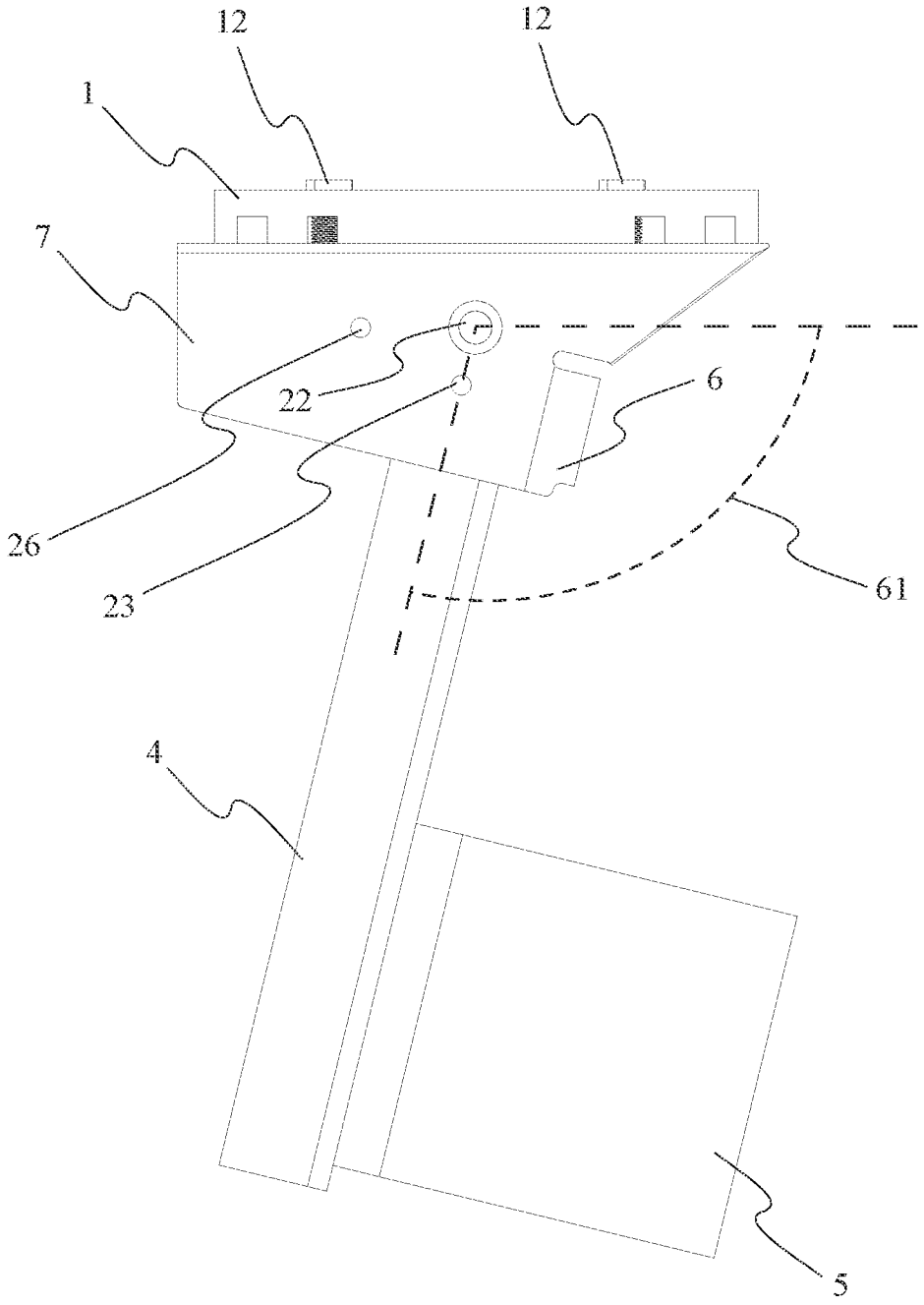
FIG. 2 is a left-side view of the present invention with dashed lines indicating the obtuse angle between the mounting surface and the linkage arm while in the deployed configuration.
Figure 3:
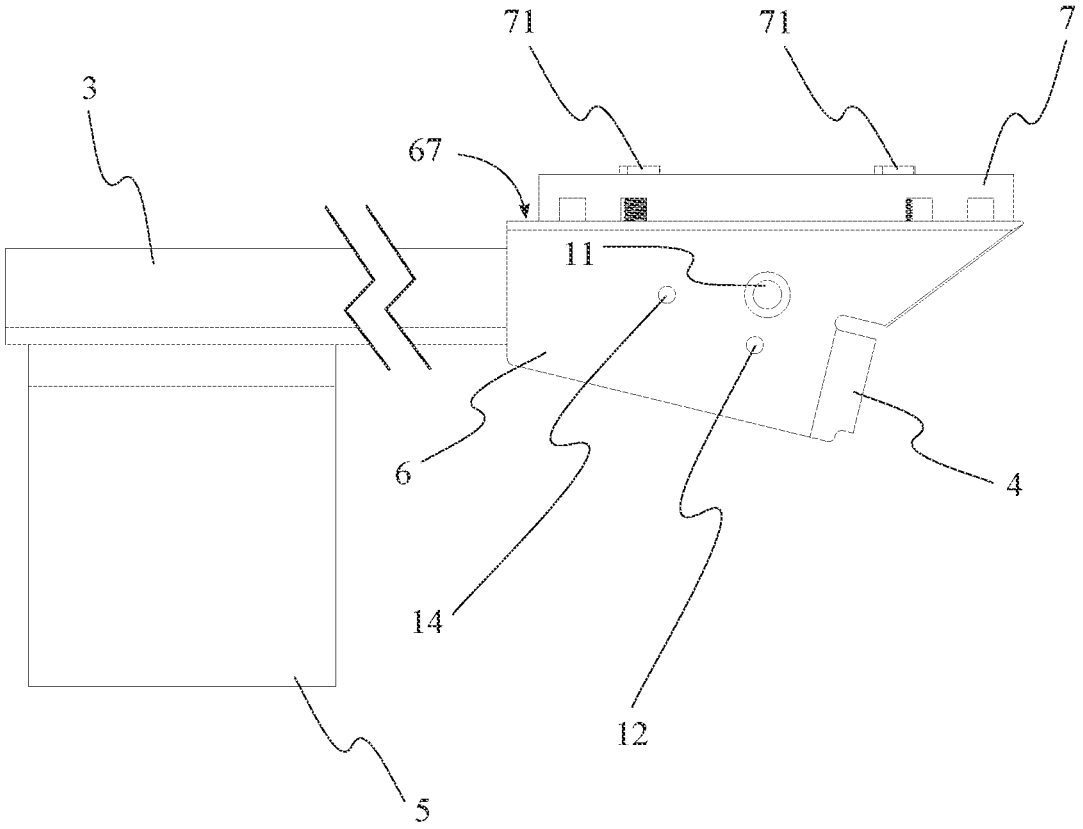
FIG. 3 is a left-side view of the present invention while in the stowed configuration.
Figure 4:
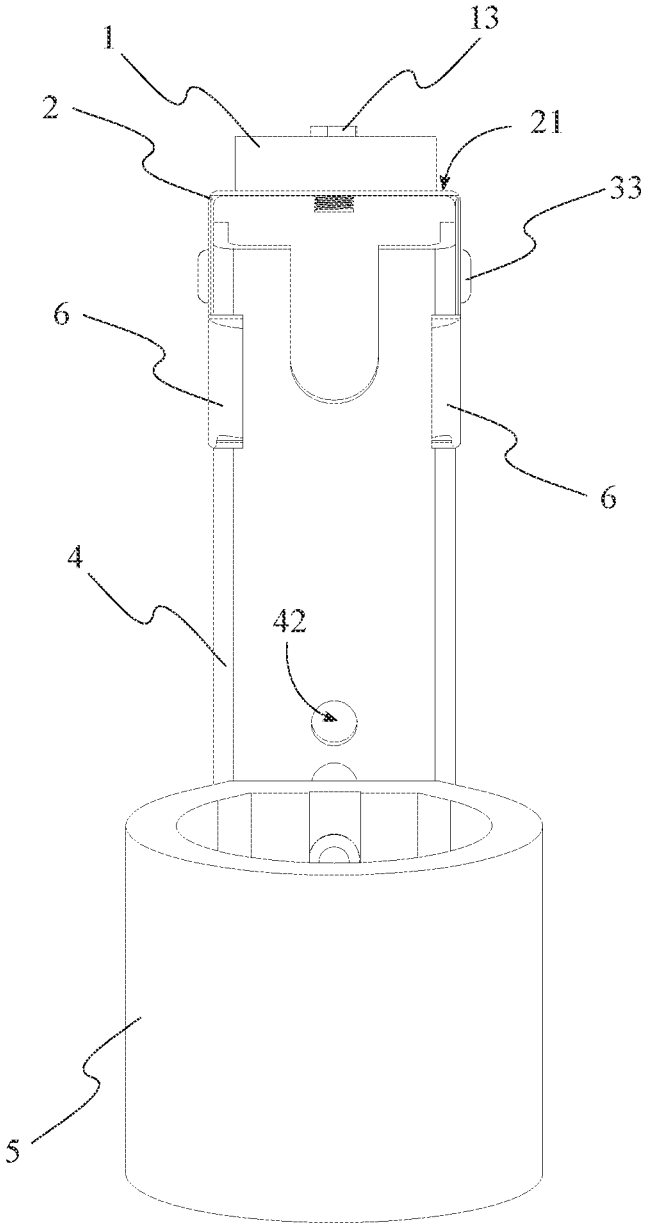
FIG. 4 is a front view of the present invention.

Referring to FIG. 1 through FIG. 3, to achieve the above-described functionality, the present invention comprises a bench connection bracket 1, an arm positioning bracket 2, an arm adjustment mechanism 3, a linkage arm 4, and a cupholder 5. The bench connection bracket 1 functions as the movable jaw of a clamping device. In this clamping device structure, a mounting surface 21 of the arm positioning bracket 2 functions as the fixed jaw against which the bench connection bracket 1 is pressed. The arm positioning bracket 2 is a rigid member that functions as an intermediary coupler between the linkage arm 4 and a bench to which the present invention is attached. Specifically, the arm positioning bracket 2 is terminally connected to the linkage arm 4 so that the linkage arm 4 can be retained in positions that enable the present invention to function as described above. The arm adjustment mechanism 3 is an adjustable coupler that enables the user to reposition the orientation of the linkage arm 4 and the cupholder 5. Further, the arm adjustment mechanism 3 is operatively connected in between the arm positioning bracket 2 and the linkage arm 4. As a result, the arm adjustment mechanism 3 enables the linkage arm 4 to be transitioned between a stowed configuration 31 and a deployed configuration 32. Embodiments of the present invention feature arm adjustment mechanisms 3 selected from the group comprising, hinges, ball joints, rail and carriage systems, cam locks, and magnetic couplers. The cupholder 5 is detachably mounted onto the linkage arm 4 and is positioned offset from the arm positioning bracket 2, across the linkage arm 4. Accordingly. The cupholder 5 is positioned to facilitate storing of personal items while the present invention is in the stowed configuration 31 or the deployed configuration 32.

Referring to FIG. 1, the present invention is designed to accommodate being mounted onto a plurality of external surfaces and devices. To facilitate this functionality, the bench connection bracket 1 serves as the interface point that enables the arm positioning bracket 2 to be mated to the external device. Embodiments, that are designed to be mounted beneath a bench with a rail or flange system to which the present invention can be clamped, further comprise at least one bench-receiving receptacle 11. The bench-receiving receptacle 11 traverses into the bench connection bracket 1 and is positioned in between the mounting surface 21 and the bench connection bracket 1. Thus positioned, the bench-receiving receptacle 11 enables the bench connection bracket 1 to be securely clamped around the bench rail. Thus, pressing the bench rail against the mounting surface 21 and fixedly attaching the present invention to the bench.

Figure 7:
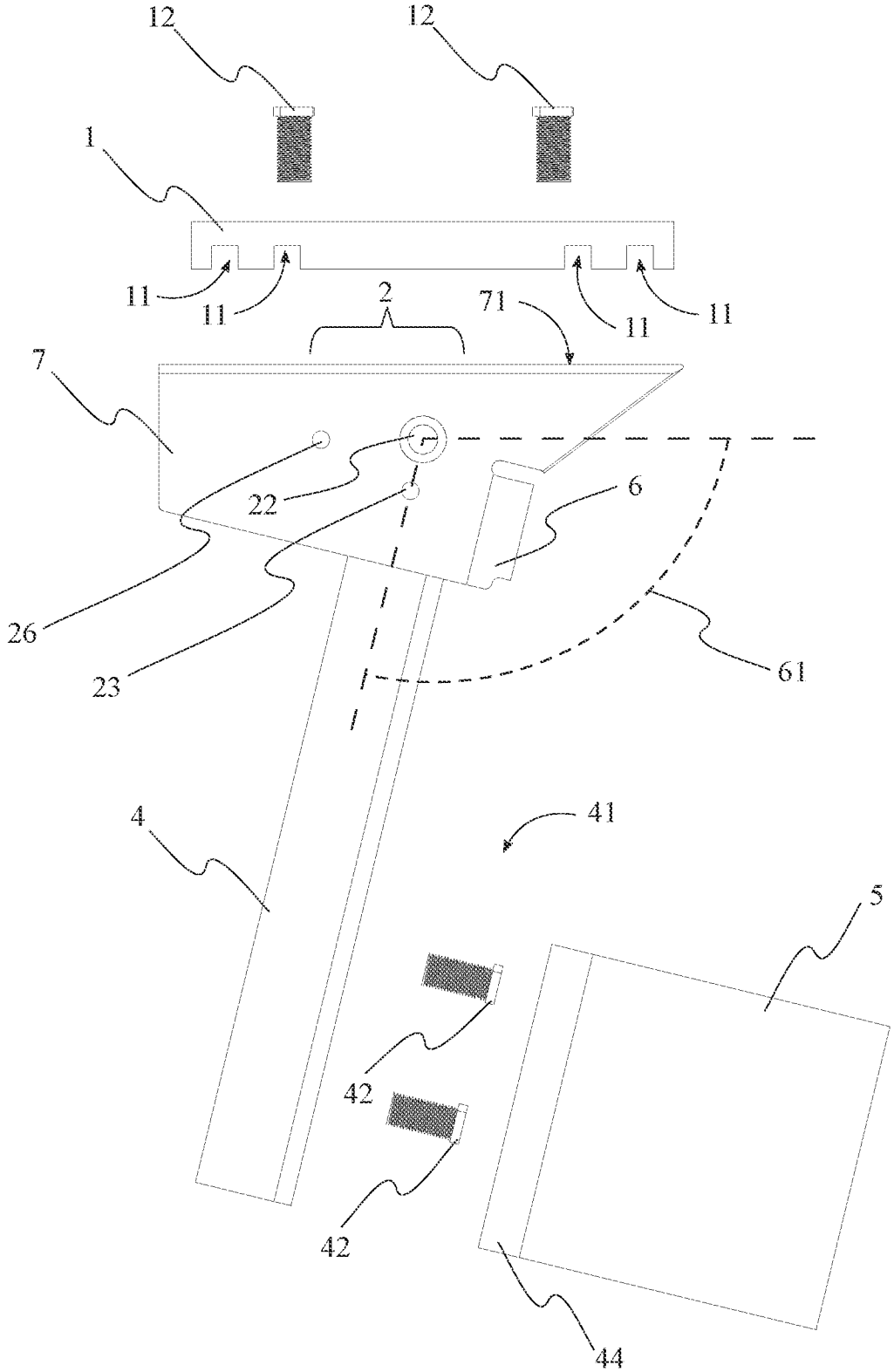
FIG. 7 is an exploded left-side view of the present invention.

Referring to FIG. 1 and FIG. 7, to further the ability to be attached to various external devices, the present further comprises a bench positioning slot 12 and at least one bench retention bolt 13. The bench positioning slot 12 normally traverses through the bench connection bracket 1 and the bench retention bolt 13 is slidably engaged along the bench adjustment slot. Further, the bench retention bolt 13 is connected in between the mounting surface 21 and the bench connection bracket 1. Accordingly, the bench retention bolt 13 enables the arm adjustment bracket to be repositioned along the bench positioning slot 12. Additionally, by tightening the bench retention bolt 13, the user is able to force the bench connection bracket 1 closer to the arm positioning bracket 2. Thereby, clamping the bench rail against the mounting surface 21.

Figure 8:
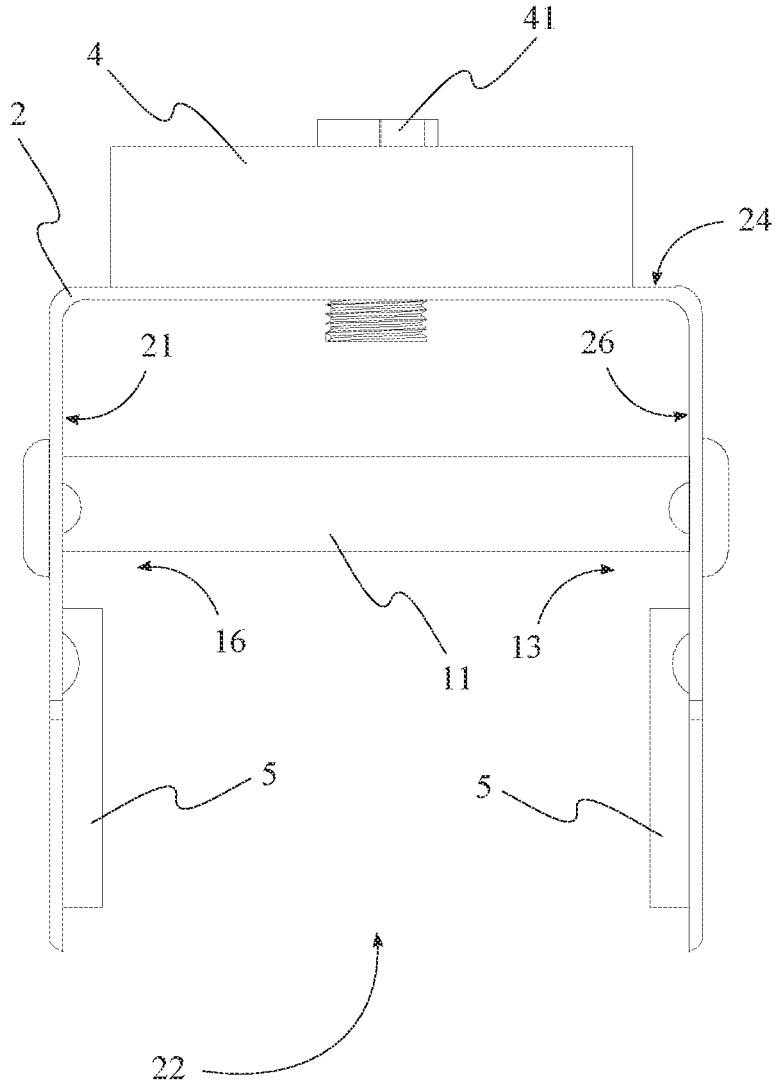
FIG. 8 is a rear view of the arm positioning bracket used in the present invention.

Referring to FIG. 1 and FIG. 8, the present invention is designed to be a discrete system that is user friendly yet robust enough to withstand exposure to extreme environments. To facilitate this, the present invention further comprises an adjustment compartment 22. The adjustment compartment 22 traverses into the arm positioning bracket 2 and is positioned opposite to the mounting surface 21, across the arm positioning bracket 2. Additionally, the arm adjustment mechanism 3 is connected in between the linkage arm 4 and the adjustment compartment 22. As a result, the adjustment compartment 22 forms an enclosure that shields the moving components of the arm adjustment mechanism 3 from contact with hazards in the external environment.

Referring to FIG. 3, FIG. 7, and FIG. 8, embodiments of the present invention are designed to employ the arm adjustment mechanism 3 to pivot the linkage arm 4 around an axis when transitioning between the stowed configuration 31 and the deployed configuration 32. To achieve this functionality, the arm adjustment mechanism 3 comprises an axle 33, a first retention assembly 34, and a second retention assembly 35. The axle 33 is connected in between a first lateral sidewall 23 of the adjustment compartment 22 and a second lateral sidewall 24 of the adjustment compartment 22. Additionally, the linkage arm 4 is rotatably mounted around the axle 33. Thus positioned, the terminal connection between the linkage arm 4 and the axle 33 causes the linkage arm 4 to pivot around the axle 33, when transitioning the cupholder 5 between the stowed configuration 31 and the deployed configuration 32. The first retention assembly 34 and the second retention assemblies are identically constructed detents. As such, the first retention assembly 34 is integrated into the first lateral sidewall 23 and the second retention assembly 35 is integrated into the second lateral sidewall 24. Thus, forming a mirrored array or detents. The linkage arm 4 is sandwiched in between the first retention assembly 34 and the second retention assembly 35. Consequently, the first retention assembly 34 and the second retention assembly 35 serve to arrest the linkage arm 4 at various positions when transitioning between the stowed configuration 31 and the deployed configuration 32.

Referring to FIG. 1 and FIG. 2, transitioning between the stowed configuration 31 and the deployed configuration 32 enables the present invention to serve the needs of many types of users in a variety of different settings. While in the stowed configuration 31, the linkage arm 4 is oriented parallel to the mounting surface 21 and the linkage arm 4 is coupled in between a first end 36 of the first retention assembly 34 and the second retention assembly 35. Accordingly, the linkage arm 4 is tucked away and the cupholder 5 cannot be jostled or bumped into by users positioned around the present invention. Preferably, the first retention assembly 34 and the second retention assembly 35 are each composed of a plurality of detents that is radially arranged around the axle 33. Further, the first end 36 of the first retention assembly 34 and the first end 36 of the second retention assembly 35 refers to the detents that retain the linkage arm 4 in an orientation parallel to the mounting surface 21 and the bench. While in the deployed configuration 32, the linkage arm 4 is angularly offset from the mounting surface 21 and the linkage arm 4 is coupled in between a second end 37 of the first retention assembly 34 and a second end 37 of the second retention assembly 35. Thus configured, the linkage arm 4 is oriented to retain the cupholder 5 in a position that facilitates storage of personal items.

Referring to FIG. 2, embodiments of the present invention are designed to retain the linkage arm 4 at an obtuse angle 61 relative to the mounting surface 21. To facilitate this, the present invention further comprises a stop bracket 6. The stop bracket 6 is mounted within the adjustment compartment 22 and is positioned offset from the arm adjustment mechanism 3, across the adjustment compartment 22. Consequently, the stop bracket 6 is designed to retain the linkage arm 4 at an obtuse angle 61 relative to the mounting surface 21, while the linkage arm 4 is in the deployed configuration 32. This configuration provides easy access to personal items stored within the cupholder 5 without enabling the personal items to protrude past the sides of the bench. Thereby, preventing the cupholder 5 from hindering the user's lateral movements along the bench. In alternative embodiments, the stop bracket 6 and the arm adjustment mechanism 3 enable the linkage arm 4 to be oriented at an angle of ninety-degrees or less, relative to the mounting surface 21.

Figure 5:
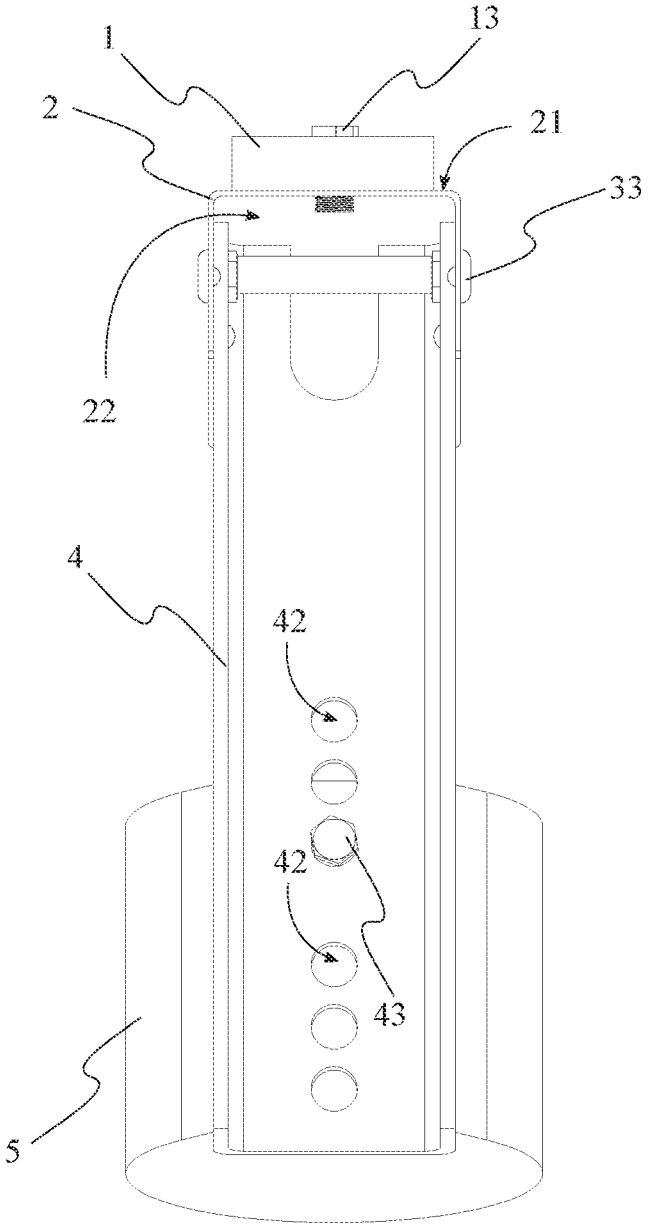
FIG. 5 is a rear view of the present invention.
Figure 6:
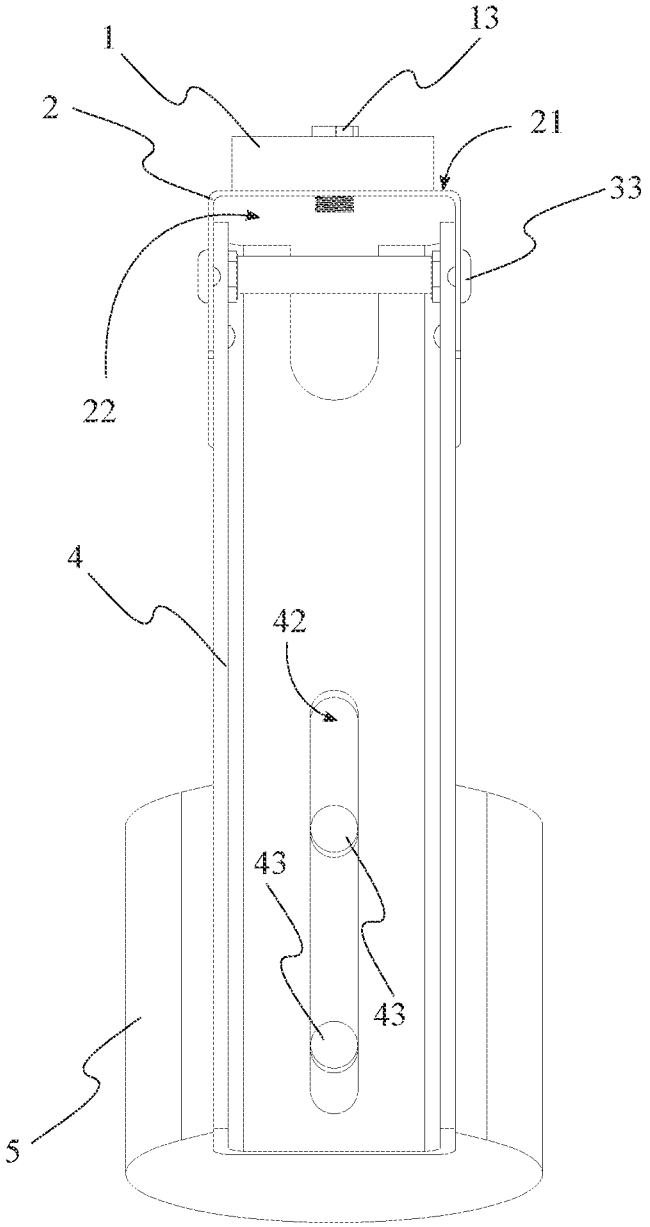
FIG. 6 is a rear view of an alternative embodiment of the present invention.

Referring to FIG. 5 through FIG. 7, the present invention is designed to be a fully adjustable system capable of being adapted to a variety of use cases. To facilitate this functionality, the present invention further comprises an adjustable coupling mechanism 41. The adjustable coupling mechanism 41 is connected in between the cupholder 5 and the linkage arm 4. Accordingly, the user is able to reposition the cupholder 5 when the present invention is in the deployed configuration 32. The adjustable coupling mechanism 41 comprises at least one mounting point 42, a mounting panel 44 and at least one fastening bolt 43. The mounting point 42 is a hole or other type of female receiver capable of engaging the fastening bolt 43. the mounting point 42 is integrated into the linkage arm 4 so that the fastening bolt 43 is able to be mated to the linkage arm 4. In some embodiments, a plurality of mounting points 42 is distributed along the linkage arm 4 so that the user is given multiple options for where the cupholder 5 should be positioned. In alternative embodiments, the mounting point 42 is a slot that traverses through the linkage arm 4 and is oriented along a longitudinal axis of the linkage arm 4. The mounting panel 44 is a flat surface used to secure the cupholder 5 to the linkage arm 4. The mounting panel 44 is laterally integrated into the cupholder 5, and the fastening bolt 43 is connected in between the mounting panel 44 and the mounting point 42. Accordingly, the fastening bolt 43 is used to anchor the cup holder to a desired position along the linkage arm 4.

Although the invention has been explained in relation to its preferred embodiment, it is to be understood that many other possible modifications and variations can be made without departing from the spirit and scope of the invention as hereinafter claimed.

What is claimed is:

1. An adjustable bench-mountable cup holder comprising:
a bench connection bracket;
an arm positioning bracket;
an arm adjustment mechanism;
a linkage arm;
a cupholder;
the bench connection bracket being attached to a mounting surface of the arm positioning bracket;
the arm positioning bracket being terminally connected to the linkage arm;
the arm adjustment mechanism being operatively connected in between the arm positioning bracket and the linkage arm, wherein, the arm adjustment mechanism enables the linkage arm to be transitioned between a stowed configuration and a deployed configuration;
the cupholder being detachably mounted onto the linkage arm; and
the cupholder being positioned offset from the arm positioning bracket, across the linkage arm.

2. The adjustable bench-mountable cup as claimed in claim 1 comprising:
the present invention further comprising at least one bench-receiving receptacle;
the bench-receiving receptacle traversing into the bench connection bracket; and
the bench-receiving receptacle being positioned in between the mounting surface and the bench connection bracket.

3. The adjustable bench-mountable cup as claimed in claim 1 comprising:
the present invention further comprising a bench positioning slot and at least one bench retention bolt;
the bench positioning slot normally traversing through the bench connection bracket;
the bench retention bolt being slidably engaged along the bench adjustment slot; and
the bench retention bolt being connected in between the mounting surface and the bench connection bracket.

4. The adjustable bench-mountable cup as claimed in claim 1 comprising:
the present invention further comprising an adjustment compartment;
the adjustment compartment traversing into the arm positioning bracket;
the adjustment compartment being positioned opposite to the mounting surface, across the arm positioning bracket; and
the arm adjustment mechanism being connected in between the linkage arm and the adjustment compartment.

5. The adjustable bench-mountable cup as claimed in claim 4 comprising:
the arm adjustment mechanism comprising an axle, a first retention assembly, and a second retention assembly;
the axle being connected in between a first lateral sidewall of the adjustment compartment and a second lateral sidewall of the adjustment compartment;
the linkage arm being rotatably mounted around the axle;
the first retention assembly being integrated into the first lateral sidewall;
the second retention assembly being integrated into the second lateral sidewall; and
the linkage arm being sandwiched in between the first retention assembly and the second retention assembly.

6. The adjustable bench-mountable cup as claimed in claim 5 comprising:
wherein the linkage arm being in the stowed configuration;
the linkage arm being oriented parallel to the mounting surface; and
the linkage arm being coupled in between a first end of the first retention assembly and the second retention assembly.

7. The adjustable bench-mountable cup as claimed in claim 5 comprising:
wherein the linkage arm being in the deployed configuration;
the linkage arm being angularly offset from the mounting surface; and
the linkage arm being coupled in between a second end of the first retention assembly and the second retention assembly.

8. The adjustable bench-mountable cup as claimed in claim 4 comprising:

the present invention further comprising a stop bracket;

the stop bracket being connected across the adjustment compartment;

the stop bracket being positioned offset from the arm adjustment mechanism across the adjustment compartment; and the stop bracket retaining the linkage arm at an obtuse angle relative to the mounting surface while the linkage arm is in the deployed configuration.

9. The adjustable bench-mountable cup as claimed in claim 1 comprising:

the present invention further comprising an adjustable coupling mechanism; and the adjustable coupling mechanism being connected in between the cupholder and the linkage arm.

10. The adjustable bench-mountable cup as claimed in claim 9 comprising:

the adjustable coupling mechanism comprising at least one mounting point, a mounting panel and at least one fastening bolt;

the mounting point being integrated into the linkage arm;

the mounting panel being laterally integrated into the cupholder; and the fastening bolt being connected in between the mounting panel and the mounting point.

11. An adjustable bench-mountable cup holder comprising:

a bench connection bracket;

an arm positioning bracket;

an arm adjustment mechanism;

a linkage arm;

a cupholder;

at least one bench-receiving receptacle;

the bench connection bracket being attached to a mounting surface of the arm positioning bracket;

the arm positioning bracket being terminally connected to the linkage arm;

the arm adjustment mechanism being operatively connected in between the arm positioning bracket and the linkage arm, wherein, the arm adjustment mechanism enables the linkage arm to be transitioned between a stowed configuration and a deployed configuration;

the cupholder being detachably mounted onto the linkage arm;

the cupholder being positioned offset from the arm positioning bracket, across the linkage arm;

the bench-receiving receptacle traversing into the bench connection bracket; and the bench-receiving receptacle being positioned in between the mounting surface and the bench connection bracket.

12. The adjustable bench-mountable cup as claimed in claim 11 comprising:

the present invention further comprising a bench positioning slot and at least one bench retention bolt;

the bench positioning slot normally traversing through the bench connection bracket;

the bench retention bolt being slidably engaged along the bench adjustment slot; and the bench retention bolt being connected in between the mounting surface and the bench connection bracket.

13. The adjustable bench-mountable cup as claimed in claim 11 comprising:

the present invention further comprising an adjustment compartment;

the adjustment compartment traversing into the arm positioning bracket;

the adjustment compartment being positioned opposite to the mounting surface, across the arm positioning bracket; and the arm adjustment mechanism being connected in between the linkage arm and the adjustment compartment.

14. The adjustable bench-mountable cup as claimed in claim 13 comprising:

the arm adjustment mechanism comprising an axle, a first retention assembly, and a second retention assembly;

the axle being connected in between a first lateral sidewall of the adjustment compartment and a second lateral sidewall of the adjustment compartment;

the linkage arm being rotatably mounted around the axle;

the first retention assembly being integrated into the first lateral sidewall;

the second retention assembly being integrated into the second lateral sidewall; and the linkage arm being sandwiched in between the first retention assembly and the second retention assembly.

15. The adjustable bench-mountable cup as claimed in claim 14 comprising:

wherein the linkage arm being in the stowed configuration;

the linkage arm being oriented parallel to the mounting surface; and the linkage arm being coupled in between a first end of the first retention assembly and the second retention assembly.

16. The adjustable bench-mountable cup as claimed in claim 14 comprising:

wherein the linkage arm being in the deployed configuration;

the linkage arm being angularly offset from the mounting surface; and the linkage arm being coupled in between a second end of the first retention assembly and the second retention assembly.

17. The adjustable bench-mountable cup as claimed in claim 13 comprising:

the present invention further comprising a stop bracket;

the stop bracket being connected across the adjustment compartment;

the stop bracket being positioned offset from the arm adjustment mechanism across the adjustment compartment; and the stop bracket retaining the linkage arm at an obtuse angle relative to the mounting surface while the linkage arm is in the deployed configuration.

18. The adjustable bench-mountable cup as claimed in claim 11 comprising:

the present invention further comprising an adjustable coupling mechanism; and the adjustable coupling mechanism being connected in between the cupholder and the linkage arm.

19. The adjustable bench-mountable cup as claimed in claim 18 comprising:

the adjustable coupling mechanism comprising at least one mounting point, a mounting panel and at least one fastening bolt;

the mounting point being integrated into the linkage arm;

the mounting panel being laterally integrated into the cupholder; and the fastening bolt being connected in between the mounting panel and the mounting point.

* * * * *